US008518616B2

(12) United States Patent
Sakimura et al.

(10) Patent No.: US 8,518,616 B2
(45) **Date of Patent: *Aug. 27, 2013**

(54) ELECTROPHOTOGRAPHIC PHOTORECEPTOR AND IMAGE FORMING METHOD

(75) Inventors: Tomoo Sakimura, Tokyo (JP); Naoki Nozaki, Shiki (JP); Teruo Sasaki, Tokyo (JP); Mayuko Ushiro, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 197 days.

This patent is subject to a terminal disclaimer.

(21) Appl. No.: 13/033,736

(22) Filed: Feb. 24, 2011

(65) Prior Publication Data

US 2011/0217641 A1 Sep. 8, 2011

(30) Foreign Application Priority Data

Mar. 8, 2010 (JP) ..... 2010-050315

(51) Int. Cl.
*G03G 5/00* (2006.01)

(52) U.S. Cl.
USPC ..... 430/60; 430/69; 430/123.4

(58) Field of Classification Search
USPC ..... 430/60, 69, 123.4
See application file for complete search history.

(56) References Cited

FOREIGN PATENT DOCUMENTS

| | | |
|---|---|---|
| CN | 101449210 | 6/2009 |
| JP | 08-320586 | 12/1996 |
| JP | 2001-289630 | 10/2001 |
| JP | 2003-091085 | 3/2003 |
| JP | 3480618 | 10/2003 |
| JP | 3894023 | 12/2006 |

OTHER PUBLICATIONS

SIPO Office Action mailing date May 29, 2012.
English Translation of SIPO Office Action mailing date May 29, 2012.
Japanese Notice of Reasons for Refusal for Patent Application No. 2011-047293.
English translation of Japanese Notice of Reasons for Refusal for Patent Application No. 2011-047293.

*Primary Examiner* — Mark A Chapman
(74) *Attorney, Agent, or Firm* — Lucas & Mercanti, LLP

(57) ABSTRACT

Reduced can be interferential streaks produced in a halftone image when using a photoreceptor support (also called a drawn tube) having been subjected to tool bit cutting processing, and provided can be an electrophotographic photoreceptor capable of obtaining high quality in response to the light printing field or the like and an image forming method employing the electrophotographic photoreceptor. Also disclosed is an electrophotographic photoreceptor possessing a cylindrical support and provided thereon, a photosensitive layer, the cylindrical support possessing a processing profile regularly formed along a central axis, provided on a circumferential surface of the cylindrical support, wherein the processing profile satisfies Formula 1: Formula 1 $\Delta L \geqq 10$ μm, where $\Delta L$, represents a difference between a processing period width and another processing period width in a central axis direction of the cylindrical support in an image region.

5 Claims, 3 Drawing Sheets

ELECTROPHOTOGRAPHIC PHOTORECEPTOR AND IMAGE FORMING METHOD

This application claims priority from Japanese Patent Application No. 2010-050315 filed on Mar. 8, 2010, which is incorporated hereinto by reference.

TECHNICAL FIELD

The present invention relates to an electrophotographic photoreceptor (referred to simply as a photoreceptor) and an image forming method applicable for forming an image having very high image quality in the light printing field or the like.

BACKGROUND

In recent years, images in a printing system accompanied with a dry electrophotographic system have been improved, and it has been utilized in a printing field for the comparatively small number of print copies. As a result, a desired image level is raised to such an extent that we have not conventionally understood it, and rare usage in the past, for example, printing onto a coated paper sheet, printing for high coverage images, printing for extremely high quality images and images exhibiting subtle tone (color tone), printing continuously for a large number of the same images, or the like has been in heavy usage. Thus, generation of failures which have not been mentioned at all is increased.

There appears one problem such as generation of interferential streaks in a halftone image seemingly originated by light exposure pattern and cutting frequency on the support surface of a photoreceptor. This is a problem which has been recurrently produced in recent years via combination of demand of improving evenness of intermediate color, performance improvement of image forming apparatuses and application for coated paper sheets, and has not been able to be handled by the conventional art.

In addition, this has conventionally responded to the foregoing problem by devising concave-convex profile on the support surface of the photoreceptor (for example, Patent Documents 1-3). The countermeasures disclosed therein might be those responding to failures regarded as the problems in the present invention. There is the limited effect, since periodicity itself in surface profile on the support of the photoreceptor, of course, remains, but produced has been the sufficient effect with respect to a quality level of images output onto plain paper sheets used at the office as main stream paper sheets. However, in the case of high image quality outputting images (output onto a coated paper sheet in the light printing field, for example) whose demand has been increased in recent years, the effect is insufficiently produced.

(Patent Document 1) Japanese Patent No. 3480618

(Patent Document 2) Japanese Patent Open to Public Inspection (O.P.I.) Publication No. 2003-91085

(Patent Document 3) Japanese Patent No. 3894023

SUMMARY

The present invention has been made to directly reduce the periodicity, and to develop a technique as an effective solution against the above-described problem.

It is an object of the present invention to reduce interferential streaks produced in a halftone image when using a photoreceptor cylindrical support (also called a drawn tube) having been subjected to tool bit cutting processing, and to provide an electrophotographic photoreceptor capable of obtaining high quality in response to the light printing field or the like and an image forming method employing the electrophotographic photoreceptor.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

The object of the present invention is accomplished by the following structures.

(Structure 1) An electrophotographic photoreceptor comprising a cylindrical support and provided thereon, a photosensitive layer, the cylindrical support comprising a processing profile regularly formed along a central axis, provided on a circumferential surface of the cylindrical support, wherein the processing profile satisfies Formula 1: Formula 1 $\Delta L \geqq 10$ μm, where ΔL represents a difference between a processing period width and another processing period width in a central axis direction of the cylindrical support within an image region.

(Structure 2) The electrophotographic photoreceptor of Structure 1, comprising the cylindrical support and provided thereon, an intermediate layer and the photosensitive layer, wherein the intermediate layer comprises a particle.

(Structure 3) An image forming method comprising the step of: forming an image employing the electrophotographic photoreceptor of Structure 1 or 2.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The present invention will be further described.

Figure 1:
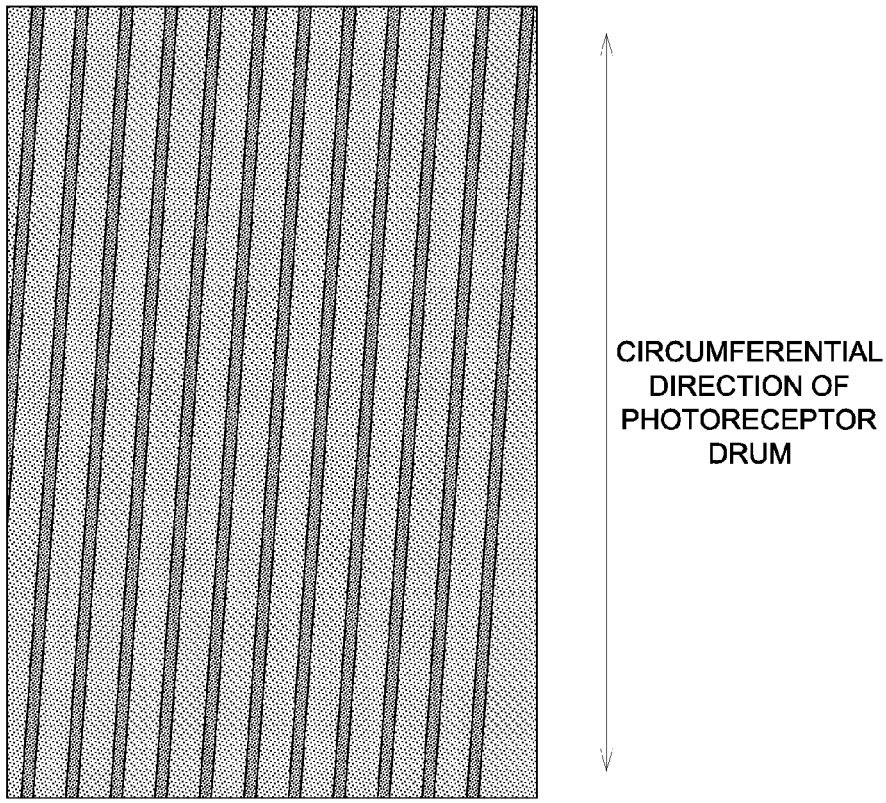
FIG. 1 is an image diagram showing streak-shaped density unevenness appearing on the final picture plane as a problem in the present invention.

Failures as a problem in the present invention caused by a phenomenon through which diagonal streak-shaped density unevenness is produced on a picture plane as shown in FIG. 1, and exhibit eye-catching feature in the even image. Specifically, there appears a problem in large screen-high quality image like in the case of light printing, together with a smooth surface image.

The inventors have found out the following reason why there appears the problem in the present invention such that interferential streaks are produced.

Figure 2:
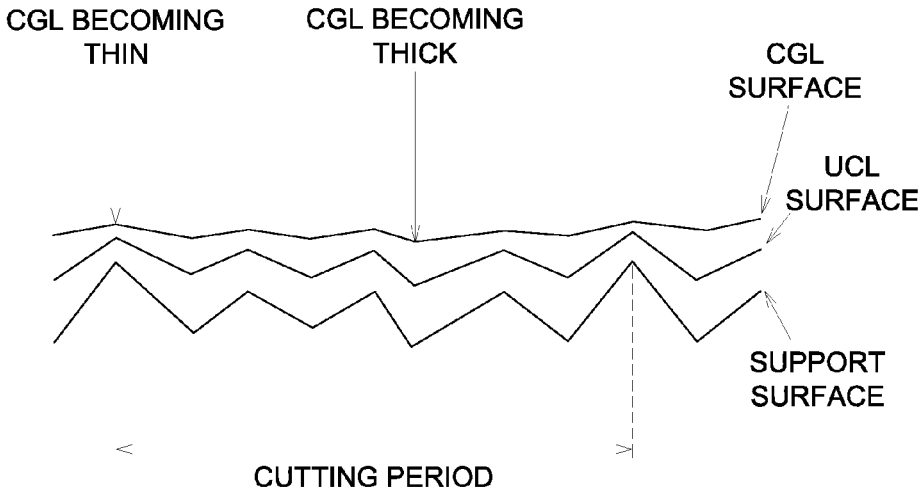
FIG. 2 is a schematic diagram showing film thickness variation of a charge generation layer caused by cutting pitch on the surface of a conductive support.

Interferential streaks are not originated by a photoreceptor support per se, but produced when the coating amount of a charge generation layer (CGL) coating solution is periodically varied in response to the surface profile of the support; film thickness after drying is periodically varied with this; and sensitivity variation locally exhibits periodicity. That is, when a photoreceptor in which film thickness of the charge generation layer as described in FIG. 2 is periodically varied (accordingly, sensitivity is periodically varied) is periodically exposed to light from a laser light source, a LED light source or the like, streak-shaped density unevenness is produced via interference between sensitivity and light exposure, both of which are periodically varied.

As to a main point of the present invention, the inventors have found out that it is extremely effective for reduction of interferential streaks to vary periodical concave-convex widths above a certain level on the surface of a cylindrical support, which are produced by cutting, and have further found out the lower limit of the variation width (difference between a processing period width and another processing period width). This limit range shows $\Delta L \geqq 10$ μm, but the reason is that in the case of less than 10 μm, image unevenness caused by interference and color tone variation at a time of a color image are generated.

Further, the upper limit is to be limited at present, depending on performance of a support processing machine, but no limitation appears to be produced by the effect of the present invention. However, speed variation depending on characteristics of a processing machine is rapidly produced by setting a large ΔL, whereby difference in level on the processing surface is generated, and streak failures tend to be produced. For this reason, the preferable range of ΔL is as follows; 300 μm$\geqq\Delta L\geqq$10 μm. The more preferable range of ΔL is also as follows; 150 μm$\geqq\Delta L\geqq$10 μm.

Further, "processing surface profile regularly formed in the direction along the central axis, provided on a cylindrical support of a photoreceptor" means a profile of concavities and convexities produced via contact of a cutting tool bit while rotating the support on the central axis when shaping the support surface via cutting processing, and the tool bit transferring rate is changed to vary the processing period width.

Next, processing of a support in the present invention will be described.

A cutting processing of a cylindrical support is carried out for the purpose of making dimensional accuracy to be in a desired level, removing an oxide film from the support surface, or making the support surface to be in the desired form, though the cutting processing is a processing in which a cutting tool bit is brought into contact with the support while rotating the support as a central axis. A support having been conventionally subjected to cutting processing becomes a processing surface profile regularly formed along the central axis, and a film thickness distribution of a layer formed on the support possesses regularity obtained by reflecting the processing surface profile, whereby the foregoing reflection does not disappear easily even though layering layers.

When a charge generation layer in a multilayer type organic electrophotographic photoreceptor which has been widely used exhibits film thickness periodicity, periodical electrical potential unevenness is generated by causing interference with periodicity possessed by an input light screen. This is visualized as periodical color unevenness in high quality images. FIG. 1 shows streak-shaped density unevenness as a problem of the present invention.

For example, in cases where intermediate layer (UCL) is provided on the photoreceptor support, and a charge generation layer is provided on the intermediate layer, the underlying surface profile means a surface profile of the intermediate layer, but it is mainly determined by the surface profile of the support and the composition of the intermediate layer (this case shown in FIG. 2).

In addition, when using an intermediate layer containing particles from those described above, random convex profile derived from the particle shape appears on the surface of the intermediate layer, and shape periodicity derived from a support can be reduced, whereby image unevenness and color tone variation failures are effectively reduced.

At any rate, it is very effective to reduce periodicity of the processing surface profile.

In order to have a ΔL of 10 μm or more as an indicator of irregularity, the processing period width needs to be frequently varied, when shaping the support surface via cutting processing. In order to do this, given may be an order to frequently vary moving speed of a tool bit with respect to the photoreceptor surface in the middle of processing.

For example, in the case of a CNC lathe to order tool bit transferring rate $X_n$ (min/revolution) and ordered location $Y_n$ (mm), carried out is a program of n blocks composed of $(X_1, Y_1)$, $(X_2, Y_2)$, - - - $(X_n, Y_n)$. When $(Y_{m+1}-Y_m)/X_m$ does not become the specified number in the $m^{th}$ block, for example, the tool bit transferring rate is reduced because of being switchable at the block endpoint, whereby the speed is increased to ordering speed $X_{m+1}$ at the next $(m+1)^{th}$ block. In this case, for example, even though $X_m$ is the same ordered speed as $X_{m+1}$, when $(Y_{m+1}-Y_m)/X_m$ does not become the specified number, since reducing speed and increasing speed occur, it is possible to change the tool bit transferring rate by utilizing them. Further, ΔL tends to be varied when changing the number of main axis revolutions, even though using the same program. The reason is that speed-changing judgment of a program made on the basis of the measured result of the tool bit is intermittently made by a digital circuit, and the interval is not sufficiently short with respect to the processing speed. In other words, the specified number is dependent upon designing and setting of a lathe, and the number of main axis revolutions.

Further, when using no CNC lathe but an analog lathe, it is possible to change a tool bit transferring rate by outputting a motor voltage to control the tool bit transferring rate through of plural resistance-switching circuits. Further, for example, it is also possible to be accomplished by moving the tool bit employing a power supply by which voltage of a designated waveform can be output.

In order to further reduce periodicity, it is preferred that the ordered interval to change the moving speed does not remain constant. For example, this is accomplished by not making $Y_n$-$Y_{n-1}$ to be constant in the case of a CNC lathe; by using plural switching timers in the case of the above-described analog lathe; employing a power source capable of introducing complexity via superimposition of an output waveform onto a different waveform; or others.

Further, It is possible to be realized by appropriately varying the revolution of a conductive support during processing to make ΔL to 10 μm or more. For example, this is accomplished by the same means as in the case of the above-described analog lathe.

ΔL, tends to become larger than the ordering value difference of the tool bit transferring rate, but it is presumably because of occurrence of the foregoing reducing speed in the case of the above-described CNC lathe, and also because of overshoot produced during variation of voltage in the case of the above-described analog lathe.

Further, the larger the number of support revolutions is, the larger the ΔL tends to be, but it is presumably effected by the vibration and wow of the rotating body.

From the above-described, it would appear that it is effective for reduction of interferential streaks of the present invention to reduce periodicity of charge generation layer thickness for the photoreceptor, and in order to realize this, it is effective to reduce periodicity of the drawn tube profile in the main scanning direction of the photoreceptor support. It is also effective to utilize an intermediate layer coating particles, since the intermediate layer has a random convex-shaped surface originated by the particle shape, resulting in reduction of periodicity originated by the drawn tube.

(Measuring Method of ΔL)

Figure 3:
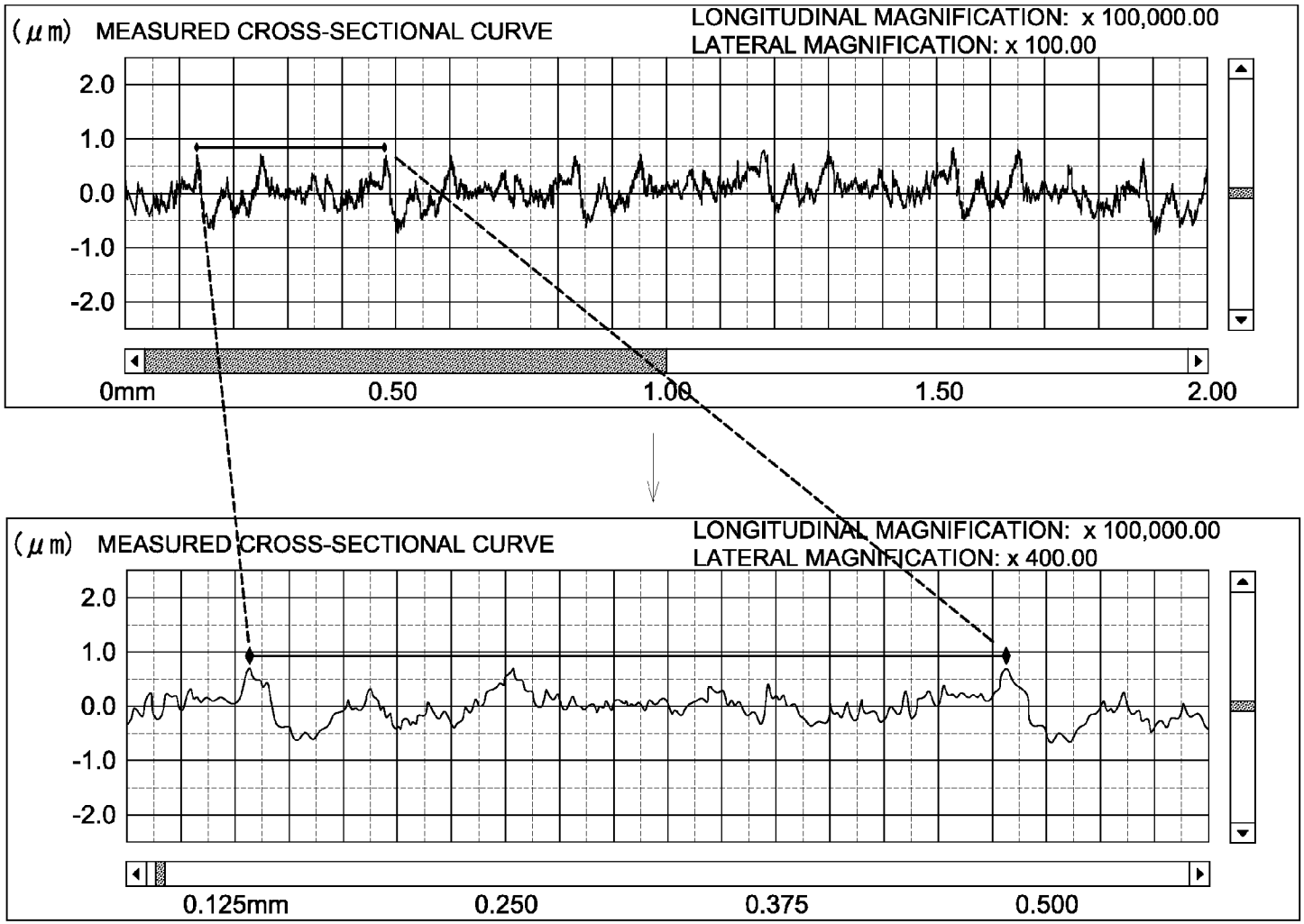
FIG. 3 indicates how to determine ΔL via measured data in the present invention.

ΔL represents a difference between a processing period width and another processing period width in the central axis direction of the cylindrical support of the present invention in an image region, and can be calculated by reading the processing period width from a cross-sectional curve or a roughness curve on the processing surface, as shown in FIG. 3, for example. That is, the period width is read out by increasing an appropriate magnification after marking a repeating profile and a period from a spectrum diagram on the upper side of FIG. 3. For example, in the case of another spectrum diagram on the lower side of FIG. 3, the lateral magnification has been quadrupled with respect to the upper side of FIG. 3.

The location to be measured may be an arbitrary location within an image region on a cylindrical support, and the arbitrary location may consist of one location, or may consist of plural locations. Further, in the present invention, ΔL, in foregoing Formula 1 may be calculated from the total processing period widths read from each location to be measured, but when the location to be measured consists of one location, it may be calculated from plural processing period widths read from the corresponding measured locations.

The length to be measured on the processing surface may be an arbitrary length as long as the processing period width can be read out, but when the location to be measured consists of one location, preferable is a length in which at least 5 processing period widths are readable, and specifically preferable is a length in which at least 10 processing period widths are readable.

As the location to be measured, a location near the center in the axis direction of the cylindrical support, for example, is chosen, and the length to be measured, for example, roughly 4 mm is chosen.

The measurement of a cross-sectional curve or a roughness curve is not specifically limited, as long as the processing period width is readable from each curve, but usable are a stylus surface roughness measuring device, laser and so forth.

As an example employing the stylus surface roughness measuring device, the following conditions are provided.

Measuring device: SURFCOM 1400D, manufactured by Tokyo Seimitsu Co., Ltd.

Measuring mode: Roughness measurement (JIS'01 Standard)

Length to be measured: 4.0 mm

Cut-off: 0.8 mm (Gaussian)

Measuring speed: 0.3 mm/sec

The difference between the maximum value and the minimum value in plural cutting periods read from a cross-sectional curve or a roughness curve measured in this manner is defined as ΔL.

[Structure of Photoreceptor]

Next, a conventional structure of the foregoing photoreceptor will be described.

In the present invention, the photoreceptor means an electrophotographic photoreceptor in which at least one function of indispensable charge generation and charge transport functions is provided in a compound for the structure of the electrophotographic photoreceptor, and in many cases, is a so-called organic photoreceptor containing commonly known organic charge generation material and organic charge transport material. The organic photoreceptor will be described below.

The organic photoreceptor of the present invention possesses at least a photosensitive layer provided on a conductive support, or possesses a protective layer further provided in order on the photosensitive layer, but the following layer structures can be specifically exemplified.

(1) A layer structure in which an intermediate layer, a charge generation layer and a charge transport layer as photosensitive layers, and a protective layer are laminated in order on a conductive support (2) Another layer structure in which an intermediate layer, a single layer containing a charge transport material and a charge generation material as a photosensitive layer, and a protective layer are laminated in order on a conductive support The layer structure of an organic photoreceptor and utilized compounds in the present invention in relation to the above-described (1) will be mainly described below.

[Conductive Substrate]

The conductive substrate to be used in the present invention (referred to also as a conductive support) is a cylindrical support exhibiting conductivity, and may be any support as long as the cylindrical support exhibits a processing profile regularly formed along a central axis, provided on a circumferential surface of the cylindrical support via cutting. Examples thereof include those in the form of a drum which are formed from a metal such as aluminum, copper, chromium, nickel, zinc, stainless steel or the like

[Intermediate Layer]

In the present invention, an intermediate layer having a bather function and an adhesion function can be provided between a conductive layer and a photosensitive layer. When considering various failure protections and so forth, a structure in which an intermediate layer is provided is preferable.

The intermediate layer can be formed via dip coating or the like by dissolving a binder resin such as casein, polyvinyl alcohol, nitrocellulose, an ethylene acrylic acid copolymer, polyamide, polyurethane, alkyd-melamine, epoxy or gelatin in a commonly known solvent. Of these, an alcohol-soluble polyamide resin is preferable.

Further, various kinds of particles (metal oxide particles and so forth) can be contained for the purpose of adjusting resistance, providing roughness and so forth for the intermediate layer. Examples thereof include alumina, zinc oxide, titanium oxide, tin oxide, antimony oxide, indium oxide, and bismuth oxide. Particles formed of indium oxide in which tin is doped, tin oxide or zirconium oxide in which antimony is doped, or the like are usable.

These metal oxides may be used singly or in combination with at least two kinds as a mixture. When at least two kinds are mixed, configuration of solid solution or fusion may be taken. Such a metal oxide preferably has an average particle diameter of 0.3 μm or less, and more preferably has an average particle diameter of 0.1 μm or less. Further, these oxide particles may be subjected to a single surface treatment or plural surface treatments with an inorganic compound or an organic compound.

As a solvent used in an intermediate layer, one commonly known is usable, but when alcohol-soluble polyamide is used for a binder, alcohols having 1-4 carbon atoms, such as methanol, ethanol, n-propyl alcohol, isopropyl alcohol, n-butanol, t-butanol and sec-butanol are preferable in view of excellent solubility and coatability of polyamide. Further, in order to improve solution coatability and a storage property, dispersibility of particles and so forth, an auxiliary solvent may be used in combination with the foregoing solvent. Examples of the auxiliary solvent capable of obtaining excellent effects include methanol, benzyl alcohol, toluene, methylene chloride, cyclohexane, tetrahydrofuran and so forth.

The density of a binder resin is appropriately selected depending on layer thickness of an intermediate layer and a production speed.

As a mixture ratio of inorganic particles to a binder resin during dispersion of the inorganic particles, 20-400 parts by volume of the inorganic particles with respect to 100 parts by volume of the binder resin are preferable, and 40-200 parts by volume of the inorganic particles with respect to 100 parts by weight of the binder resin are more preferable.

As a means to disperse inorganic particles, an ultrasonic homogenizer, a ball mill, a bead mill, a sand grinder and a homogenizing mixer are usable, but the present invention is not limited thereto. A bead mil employing beads having an average particle diameter of 0.1-0.5 mm is preferred. In addition, as to an intermediate layer coating solution, generation of image defects can be inhibited by filtrating foreign matter and an aggregate before coating the solution.

A method of drying the intermediate layer can be appropriately selected depending on kinds of solvents, binder resins and layer thickness, but thermal drying is preferable.

The intermediate layer preferably has a layer thickness of 0.1-30 μm, and more preferably has a layer thickness of 0.3-15 μm.

[Charge Generation Layer]

A charge generation layer used in the present invention contains a charge generation material and a binder resin, and is preferably formed by dispersing the charge generation material in a binder resin solution, followed by coating.

Examples of the charge generation material include azo pigments such as Sudan Red and Diane Blue; quinone pigments such as pilene quinone and anthoanthrone; quinocyanine pigments; perylene pigments; indigo pigments such as indigo and thioindigo; and phthalocyanine pigments, but the present invention is not limited thereto. These charge generation materials can be used singly or in the form of a dispersion in which materials are dispersed in a commonly known resin.

As a binder resin for the charge generation layer, a commonly known resin is usable. Examples thereof include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, a copolymer resin containing at least two of these resins (e.g., a vinyl chloride-vinyl acetate copolymer resin, and a vinyl chloride-vinyl acetate-anhydrous maleic acid copolymer resin), a polyvinyl carbazole resin, and so forth, but the present invention is not limited thereto.

As to formation of a charge generation layer, it is preferred that a charge generation material is dispersed in a solution in which a binder resin is dissolved in a solvent employing a dispersing apparatus to prepare a coating solution, the coating solution is coated with a coater so as to give a predetermined thickness, and the coating film is dried to prepare the charge generation layer.

Examples of the solvent for coating after dissolving a binder resin, which is used for the charge generation layer, include toluene, xylene, methylene chloride, 1,2-dichloroethane, methyl ethyl ketone, 4-methoxy-4-methyl-2-pentane, cyclohexane, ethyl acetate, butyl acetate, methanol, ethanol, propanol, butanol, methyl cellosolve, ethyl cellosolve, tetrahydrazine, 1-dioxane, 1,3-dioxolane, pyridine and diethyl amine, but the present invention is not limited thereto.

Usable examples of a dispersing means for the charge generation material include an ultrasonic homogenizer, a ball mill, a sand grinder, a homogenizing mixer and so forth, but the present invention is not limited thereto.

The mixing ratio of the charge generation material to the binder resin is preferably 10-600 parts by weight with respect to 100 parts by weight of the binder resin, and more preferably 50-500 parts by weight. The layer thickness of the charge generation layer differs depending on properties of the charge generation material, properties of the binder resin, and a mixing ratio thereof, but is preferably 0.01-5 μm, and more preferably 0.05-3 μm. In addition, generation of image defects can be inhibited by filtering foreign matter and aggregates before coating a coating solution for the charge generation layer. The charge generation layer can also be formed via vacuum evaporation of the foregoing pigment.

[Charge Transport Layer]

A charge transport layer used in a photosensitive layer of the present invention contains a charge transport material (CTM) and a binder resin, and is formed via coating after dissolving the charge transport material in a binder resin solution.

Examples of the charge transport material include a carbazole derivative, an oxazole derivative, an oxadiazole derivative, a thiazole derivative, a thiadizole derivative, a triazole derivative, an imidazole derivative, an imidazolone derivative, an imidazolidine derivative, a bisimidazolidine derivative, a styryl compound, a hydrazone compound, a pyrazoline compound, an oxazolone derivative, a benzoimidazole derivative, a quinazoline derivative, a benzofuran derivative, an acridine derivative, a phenazine derivative, an aminostilbene derivative, a triaryl amine derivative, a phenylene diamine derivative, a stilbene derivative, a benzidine derivative, poly-N-vinyl carbazole, poly-1-vinyl pyrene and poly-9-vinyl anthracene, a triphenyl amine derivative and so forth, and these may be used by mixing at least two kinds.

A commonly known resin can be used as a binder resin for the charge transport layer, and examples thereof include a polycarbonate resin, a polyacrylate resin, a polyester resin, a polystyrene resin, a styrene-acrylnitryl copolymer resin, a polymethacrylic acid ester resin, and a styrene-methacrylic acid ester copolymer resin, but the polycarbonate resin is preferable. Further, BPA, BPZ, dimethyl BPA, and a BPA-dimethyl BPA copolymer are preferable in view of crack resistance, wear resistance, and an electrification property.

As to formation of a charge transport layer, it is preferred that a binder resin and a charge transport material are dissolved to prepare a coating solution; the coating solution is coated with a water so as to give the predetermined layer thickness; and the coating film is dried to prepare charge transport layer.

Examples of the solvent to dissolve the binder resin and the charge transport material include toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1, 3-dioxolane, pyridine and diethyl amine, but the present invention is not limited thereto.

The mixing ratio of the charge transport material to the binder resin is preferably 10-500 parts by weight of the charge transport material with respect to 100 parts by weight of the binder resin, and more preferably 20-100 parts by weight of the charge transport material.

The layer thickness of the charge transport layer differs depending on properties of the charge transport material, properties and a mixing ratio of the binder resin, but it is preferably 5-40 μm, and more preferably 10-30 μm.

An antioxidant, an electronic conductive agent and a stabilizer may be added into the charge transport layer. Antioxidants disclosed in Japanese Patent O.P.I. publication No. 2000-305291 may be used, and electronic conductive agents disclosed in Japanese Patent O.P.I. Publication No. 50-137543 and Japanese Patent O.P.I. Publication No. 58-76483 may be used.

A protective layer may be provided on the outermost surface of a photoreceptor of the present invention, if desired.

The electrostatic latent image formed on the photoreceptor of the present invention is visualized as a toner image via development. The toner to be used for the development may be crushed toner or polymerized toner, but the toner of the present invention is preferably a polymerized toner prepared by a polymerization method from the viewpoint of realization of a stable particle size distribution.

The polymerized toner means a toner formed via preparation of a binder resin for the toner, polymerization of a raw material monomer for the binder resin to be of toner shape, and a subsequent chemical treatment, if desired.

To be more concrete, the foregoing toner means a toner formed via polymerization reaction such as suspension polymerization, emulsion polymerization or the like, and a particle-to-particle fusing process subsequently carried out, if desired.

In addition, the volume average particle diameter, that is, 50% volume particle diameter (Dv50) is preferably 2-9 μm, and more preferably 3-7 μm. High resolution can be obtained by falling the volume average particle diameter in this range. Further, an existing amount of toner having a fine particle diameter can be reduced in combination with the above-described range, though the toner is one having a small particle diameter, whereby improved dot image reproduction is obtained for a long duration, and stable images exhibiting excellent sensitivity can be formed.

The toner of the present invention may be used as a single component developer or a two-component developer.

When the toner is used as a single component developer, provided is a nonmagnetic single component developer, or a magnetic single component developer containing magnetic particles of approximately 0.1-0.5 μm in size in the toner, and both the nonmagnetic single component developer and the magnetic single component developer are usable.

The toner may be used as a two-component developer by mixing with a carrier. In this case, commonly known materials which are metal such as iron, ferrite, magnetite or the like, an alloy of such the metal and another metal such as aluminum, lead or the like, and so forth are usable as magnetic particles for carrier. Ferrite is specifically preferred. The above-described magnetic particles may preferably have a volume average particle diameter of 15-100 μm, and more preferably have a volume average particle diameter of 25-80 μm.

The volume average particle diameter of the carrier can be measured with a laser diffraction system particle size distribution measuring device "HELOS" (manufactured by SYMPATEC Co.).

As the carrier, preferably used are one obtained by coating magnetic particles with a resin, or a so-called resin dispersion type carrier prepared by dispersing magnetic particles in a resin. A resin composition for the coating is not specifically limited, but examples thereof include an olefin based resin, styrene based resin, a styrene-acryl based resin, a silicone based resin, an ester based resin and a fluorine-containing polymer based resin. Further, a resin to form the resin dispersion type carrier is not specifically limited, and any of those known in the art can be used. Usable examples thereof include a styrene-acryl based resin, a polyester resin, a fluorine based resin and a phenol based resin.

[Image Forming Method]

Next, an image forming apparatus used in an image forming method employing a photoreceptor of the present invention will be described.

Figure 4:
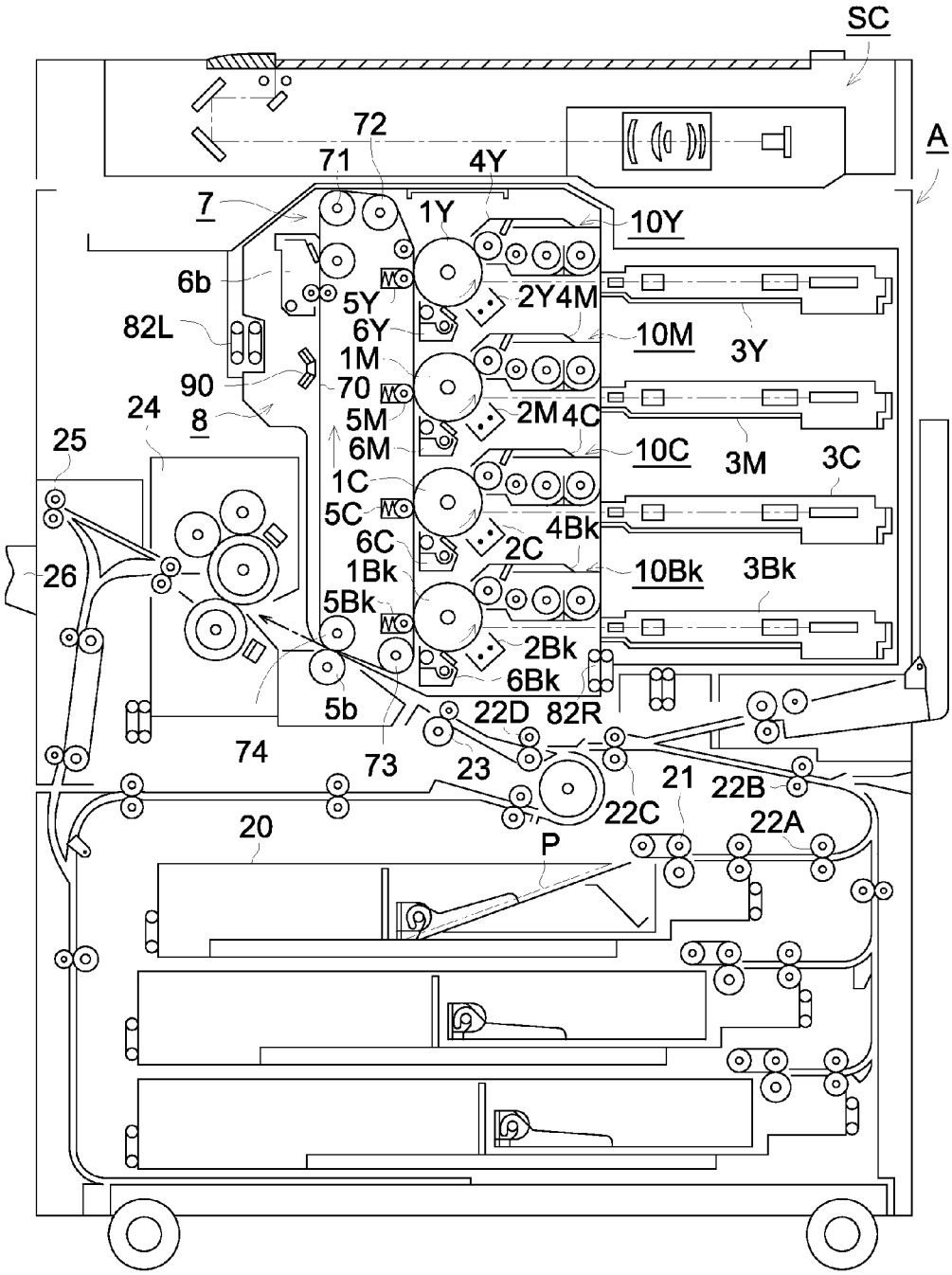
FIG. 4 is a schematic diagram showing an example of a color image forming apparatus equipped with an electrophotographic photoreceptor of the present invention.

FIG. 4 is a cross-sectional diagram of a color image forming apparatus in an embodiment of the present invention.

In an image forming apparatus of the present invention, when an electrostatic latent image is formed on a photoreceptor, a semiconductor laser or a light-emitting diode having an oscillation wavelength of 350-850 nm is used as an image exposure light source. Using such an image exposure light source, a light exposure dot diameter in the primary scanning direction of writing is narrowed to 10-100 μm, and digital light exposure is conducted on an organic photoreceptor to obtain an electrophotographic image at a high resolution of from 600 dpi to 2400 dpi or more (dpi: the number of dots per 2.54 cm).

The light beam to be used includes the beams of the scanning optical system using the semiconductor laser, solid scanner such as an LED and so forth. The distribution of the light intensity includes Gauss distribution and Lorenz distribution. The portion exceeding $1/e^2$ of each peak intensity is assumed as a light exposure dot diameter of the present invention.

This color image forming apparatus is called the so-called tandem type color image forming apparatus, and comprises four sets of image forming sections (image forming units) 10Y, 10M, 10C, and 10Bk, endless belt shaped intermediate transfer member unit 7, sheet feeding and conveyance device 21, and fixing device 24. The original document reading apparatus SC is placed on top of main unit A of the image forming apparatus.

Four sets of image forming units 10Y, 10M, 10C, and 10Bk are constituted, centering on photoreceptor drums 1Y, 1M, 1C, and 1Bk, by rotating charging devices 2Y, 2M, 2C, and 2Bk, image wise light exposure devices 3Y, 3M, 3C, and 3Bk, rotating developing devices 4Y, 4M, 4C, and 4Bk, and cleaning devices 5Y, 5M, 5C, and 5Bk that clean photoreceptor drums 1Y, 1M, 1C, and 1Bk.

Image forming units 10Y, 10M, 10C, and 10Bk, all have the same configuration excepting that the color of the toner image formed in each unit is different on respective photoreceptor drums 1Y, 1M, 1C, and 1Bk, and detailed description is given below taking the example of image forming unit 10Y.

Image forming unit 10Y has, placed around photoreceptor drum 1Y which is the image forming body, charging device 2Y (hereinafter referred to merely as charging unit 2Y or charger 2Y), light exposure device 3Y, developing device 4Y, and cleaning device 5Y (hereinafter referred to simply as cleaning device 5Y or as cleaning blade 5Y), and forms yellow (Y) colored toner image on photoreceptor drum 1Y. Further, in the present preferred embodiment, at least photoreceptor drum 1Y, charging device 2Y, developing device 4Y, and cleaning device 5Y in image forming unit 10Y are provided in an integral manner.

Charging device 2Y is a device that applies a uniform electrostatic potential to photoreceptor drum 1Y, and corona discharge type charger 2Y is being used for photoreceptor drum 1Y in the present preferred embodiment.

Imagewise light exposure device 3Y is a device that conducts light exposure, based on an image signal (Yellow), and forms an electrostatic latent image corresponding to the yellow color image. This light exposure device 3Y is one composed of LED arranged in the form of an array in the axis direction of photoreceptor drum 1Y, and an image focusing element, or is a laser optical system, but one in the present figure is a laser optical system.

The image forming apparatus of the present invention may be configured in such a way that the constituents such as the foregoing photoreceptor, a developing device, a cleaning device and so forth are integrally combined to a process cartridge (image forming unit), and this image forming unit may be installed in the apparatus main body as a detachable unit. It is also possible to arrange such a configuration that at least one of the charging device, the imagewise light exposure device, the developing device, the transfer or separation device and the cleaning device is integrally supported with the photoreceptor to form a process cartridge (image forming unit) as a single detachable image forming unit, employing a guide device such as a rail of the apparatus main body.

Intermediate transfer member unit 7 in the form of an endless belt is wound around a plurality of rollers, and has endless belt shaped intermediate transfer member 70 which acts as a second image carrier in the shape of a partially conducting endless belt which is supported in a free manner to rotate.

The images of different colors formed by image forming units 10Y, 10M, 10C, and 10Bk, are successively transferred on to rotating endless belt shaped intermediate transfer member 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final Exed image: for example, plain paper, transparent sheet, etc.,) is fed from sheet feeding device 21, pass through a plurality of intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24, and is gripped by sheet discharge rollers 25 and placed above sheet discharge tray 26 outside the equipment. Here, the transfer supporting body of the toner image fanned on the photoreceptor of the intermediate transfer body or of the transfer material, etc. is collectively called a transfer medium.

On the other hand, after the color image is transferred to transfer material P by secondary transfer roller 5*b* functioning as the secondary transfer section, endless belt shaped intermediate transfer member 70 from which transfer material P has been separated due to different radii of curvature is cleaned by cleaning device 6*b* to remove the remaining toner.

During image formation processing, primary transfer roller 5Bk is at all times contacting against photoreceptor 1Bk. Other primary transfer rollers 5Y, 5M, and 5C come into contact with photoreceptors 1Y, 1M, and 1C, respectively, only during color image formation.

Secondary transfer roller 5*b* comes into contact with endless belt shaped intermediate transfer body 70 only when secondary transfer is conducted with transfer material P passing through this.

Further, chassis 8 can be pulled out via supporting rails 82L and 82R from body A of the apparatus.

The image forming apparatus of the present invention is commonly suitable for electrophotographic apparatuses such as electrophotographic copiers, laser printers, LED printers, liquid crystal shutter type printers and so forth. Further, the image forming apparatus can be widely utilized for apparatuses for displaying, recording, light printing, plate making and facsimile to which an electrophotographic technique is applied.

EXAMPLE

Next, typical embodiments are shown to further describe the present invention, but the embodiments in the present invention are not limited thereto.

Example 1

<Preparation of Support>1

An aluminum alloy drawn tube having a length of 362 mm was placed onto a CNC lathe, and subjected to cutting with a diamond sintered tool bit so as to give an outer radius of 59.95 mm, and a surface roughness Rz of 0.75 μm.

Cutting was conducted at 6000 rpm as the number of main axis revolution at this time by an increase-decrease repeating program in which the tool bit transferring rate changes 0.005 mm for each 1.5 mm between a tool bit transferring rate of 0.340 mm/revolution and a tool bit transferring rate of 0.360 mm/revolution. ΔL was 50 μm.

The ΔL measurement was conducted around the center of a drawn tube in JIS'01 Standard for roughness measurement with a measured length of 4.0 mm, a cut-off of 0.8 mm (Gaussian) and a measuring speed of 0.3 mm/sec, employing SURFCOM 1400D, and is the difference between the maximum value and the minimum value in cutting period read from the resulting cross-sectional curve.

<Preparation of Photoreceptor 1>

(Formation of Intermediate Layer 1)

After one part by weight of binder resin (N−1) was added into 20 parts by weight of ethanol/n-propylalcohol/tetrahydrofuran (45:20:30 in volume ratio), and dissolved while stirring, rutile type titanate oxide particles having been subjected to a surface treatment with 5% by weight of methylhydrogen polysiloxane were mixed to disperse the mixed solution employing a bead mill. In this case, dispersing was carried out employing zirconia beads having an average particle diameter of 0.5 mm, a filling ratio of 80%, a peripheral speed of 4 msec, and a mill residence time of 3 hours to prepare an intermediate layer coating solution. After filtering this solution with a polypropylene filter element having a filtration accuracy of 5 μm, the intermediate layer coating solution was coated onto the outer circumference after washing "support 1" prepared above by an immersion coating method, followed by drying at 120° C. for 20 minutes to form "intermediate layer 1" having a dry thickness of 2 μm.

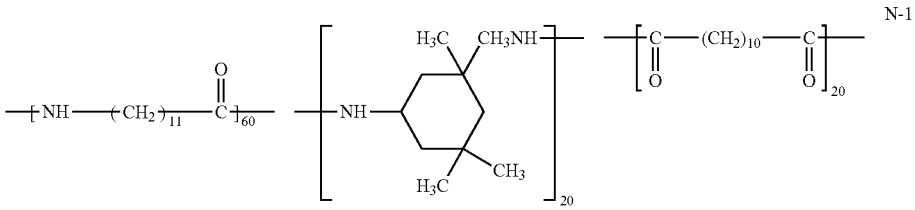

N-1

(Formation of Charge Generation Layer)

The following components were mixed and dispersed employing a sand mill homegenizer to prepare a charge generation layer coating solution. This coating solution was coated on an intermediate layer by an immersion coating method to form "charge generation layer 1" having a dry thickness of 0.3 μm.

| | |
|---|---|
| Y-titanylphthalocyanine {a titanylphthalocyanine pigment having a maximum diffraction peak at a Bragg angle (2θ ± 0.2°) of 27.3° in an X-ray diffraction spectrum with Cu-Kα characteristic X-ray} | 20 parts by weight |
| Polyvinyl butyral (BX-1, produced by Sekisui Chemical Co., Ltd.) | 10 parts by weight |
| Methylethyl ketone | 700 parts by weight |
| Cyclohexanone | 300 parts by weight |

(Formation of Charge Transport Layer)

The following components were mixed and dissolved to prepare a charge transport layer coating solution. This solution was coated on the foregoing charge generation layer by an immersion coating method, followed by drying at 120° for 70 minutes to form "charge transport layer" having a dry thickness of 20 μm.

| | |
|---|---|
| Charge transport layer (having the following structure) | 50 parts by weight |
| Polycarbonate resins "IUPILON-Z300" (produced by Mitsubishi Gas Chemical Company Inc.) | 100 parts by weight |
| Antioxidant (2,6-di-t-butyl-4-methylphenol) | 8 parts by weight |
| Tetrahydrofuran/toluene (8/2 in volume ratio) | 750 parts by weight |

Charge Transport Material

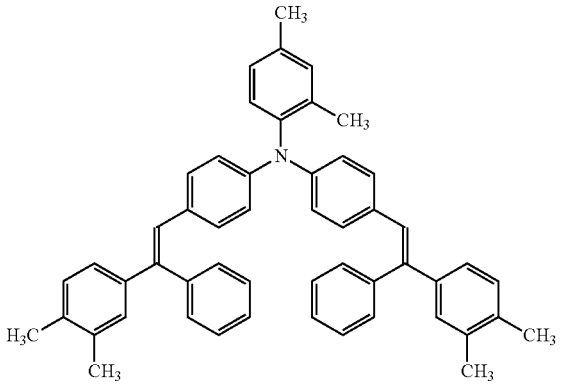

Example 2

A photoreceptor was prepared similarly to preparation of the photoreceptor in Example 1, except that the number of main axis revolutions was set to 2000 rpm during cutting in Example 1, and a support was processed with the same program. ΔL of an aluminum alloy drawn tube (support 2) at this time was 30 μm.

Example 3

A photoreceptor was prepared similarly to preparation of Example 2, except that operation was made with a program in which the tool bit transferring rate changes for each 1.5 mm between a tool bit transferring rate of 0.340 mm/revolution and a tool bit transferring rate of 0.345 mm/revolution in Example 2. ΔL of a drawn tube (support 3) at this time was 10 μm Example 4

A photoreceptor was prepared similarly to preparation of the photoreceptor in Example 3, except that the following intermediate layer 2 was provided in the photoreceptor.

(Formation of Intermediate Layer 2)

One part by weight of binder resin (N−1) was added into 20 parts by weight of ethanol/n-propylalcohol/tetrahydrofuran (45:20:30 in volume ratio), and dissolved while stirring. After filtering the solution with a 5 μm filter, an intermediate layer coating solution was coated onto the outer circumference after washing "support 3" prepared above by an immersion coating method to form "intermediate layer 2" having a dry thickness of 1 μm.

Example 5

A photoreceptor was prepared similarly to preparation of the photoreceptor in Example 1, except that the following support 4 was employed as a support. An aluminum alloy drawn tube is placed onto a CNC lathe with the number of main axis revolutions at 4000 rpm, and subjected to cutting with a diamond sintered tool bit so as to give a surface roughness Rz of 0.75 μm to obtain support 4. In this case, taking the drawn tube end as a starting point, the tool bit transferring rate value was set to remain constant at 400 μm/revolution, and processing distances were set so as to repeat 1.43 mm, 2.28 mm, 1.64 mm, 2.49 mm, 1.85 mm, 2.71 mm, 2.06 mm and 2.92 mm in a tool bit moving program. ΔL at this time was 20 μm.

Example 6

A photoreceptor was prepared similarly to preparation of the photoreceptor in Example 1, except that the following support 5 was employed as a support. An aluminum alloy drawn tube is placed onto a CNC lathe with the number of main axis revolutions at 3160 rpm, and subjected to cutting with a diamond sintered tool bit so as to give a surface roughness Rz of 0.75 μm to obtain support 5. In this case, taking the drawn tube end as a starting point, the tool bit transferring rate value was set to remain constant at 400 μm/revolution, and processing distances were set so as to repeat 2.20 mm, 2.21 mm, 2.22 mm, 2.23 mm, 2.24 mm, 2.23 mm, 2.22 mm, and 2.21 mm in a tool bit moving program. ΔL at this time was 65 μm.

Example 7

A photoreceptor was prepared similarly to preparation of the photoreceptor in Example 1, except that the following support 6 was employed as a support. An aluminum alloy drawn tube is placed onto an analog lathe with the number of main axis revolutions at 3160 rpm, and subjected to cutting with a diamond sintered tool bit so as to give a surface roughness Rz of 0.75 p.m to obtain support 6. A voltage through a circuit in which a timer was used in combination with resistance and so forth was input into a tool bit moving motor in such a way that the number of main axis revolutions in this case became 3200 rpm, and as the tool bit moving value in terms of processing distance-speed ordering value repeated were 0.5 mm-380 μm/revolution, 0.5 mm-380 μm/revolution, 1.6 mm-390 μm/revolution, 2.8 mm 380 μm/revolution, 1.1 mm-390 μm/revolution, 2.5 mm-380 μm/revolution, and 3.2 mm 390 μm/revolution. ΔL, was 25 μm.

Comparative Example 1

A photoreceptor was prepared similarly to preparation of the photoreceptor in Example 1, except that the following substrate 7 was employed as a support. The number of main axis revolutions was set to 3000 rpm; and the tool bit transferring rate remains unchanged at 0.350 mm/rev to obtain support 7 having a ΔL of 3 μm.

Comparative Example 2

A photoreceptor was prepared similarly to preparation of the photoreceptor in Example 1, except that the following support 8 was employed as a support. An aluminum alloy drawn tube is placed onto a CNC lathe with the number of main axis revolutions at 4000 rpm, and subjected to cutting with a diamond sintered tool bit so as to give a surface roughness Rz of 0.75 μm to obtain support 8. In this case, taking the drawn tube end as a starting point, the tool bit transferring rate value was set to remain constant at 400 μm/revolution, and processing distances were set so as to repeat 1.47 mm, 2.32 mm, 1.68 mm, 2.53 mm, 1.89 mm, 2.75 mm, 2.10, and 2.96 mm in a tool bit transferring program. ΔL at this time was 65 μm.

(Performance Evaluation)

For performance evaluations, utilized is bizhub PRO C6501 manufactured by Konica Minolta Business Technologies, Inc. to visially evaluate halftone images output by using light exposure pattern A (the evaluation made in the following 17 gradations; density ordering values of 0/255, 15/255, 31/255, 47/255, 63/255, 79/255, 95/255, 111/255, 127/255, 143/255, 159/255, 175/255, 191/255, 207/255, 223/255, 2239/255, and 255/255), light exposure pattern B (the evaluation made in the following 17 gradations; density ordering values of 0/255, 15/255, 31/255, 47/255, 63/255, 79/255, 95/255, 111/255, 127/255, 143/255, 159/255, 175/255, 191/255, 207/255, 223/255, 2239/255, and 255/255) and light exposure pattern C (the evaluation made in the following 17 gradations; density ordering values of 0/255, 15/255, 31/255, 47/255, 63/255, 79/255, 95/255, 111/255, 127/255, 143/255, 159/255, 175/255, 191/255, 207/255, 223/255, 2239/255, and 255/255) at black (Bk) position, together with "POD GLOSS COAT (100 g/m$^2$)" produced by Oji Paper Co., Ltd.

(Diagonal Streaks Caused by Interference)

Light exposure patterns A and B are used. Results obtained via evaluation based on the following criteria are shown in Table 1.

A: No diagonal streak is observed at all.

B: Diagonal streaks are slightly observed, but there appears no practical problem.

C: Diagonal streaks are observed, and there appears a practical problem.

(Streak in the Photoreceptor Circumferential Direction, Caused by Cutting Failure)

Light exposure pattern C is used. Results evaluated in accordance with the following criteria are shown in Table 1.

A: No streak in the photoreceptor circumferential direction is observed at all.

B: Streaks in the photoreceptor circumferential direction are slightly observed, but there appears no practical problem.

C: Streaks in the photoreceptor circumferential direction are observed, and there appears a practical problem.

TABLE 1

| | Support | ΔL | Inter-mediate layer | Light exposure pattern A | Light exposure pattern B | Light exposure pattern C |
|---|---|---|---|---|---|---|
| Example 1 | 1 | 50 | 1 | A | A | A |
| Example 2 | 2 | 30 | 1 | A | A | A |
| Example 3 | 3 | 10 | 1 | A | B | A |
| Example 4 | 3 | 10 | 2 | B | B | A |
| Example 5 | 4 | 20 | 1 | A | A | A |
| Example 6 | 5 | 65 | 1 | A | A | B |
| Example 7 | 6 | 25 | 1 | A | A | A |
| Comparative example 1 | 7 | 3 | 1 | C | C | A |
| Comparative example 2 | 8 | 8 | 1 | B | C | A |

Light exposure pattern A: bizhub PRO C6501 Internally provided pattern No. 53 Dot 1; typical one among light exposure patterns regularly formed in the form of dots.
Light exposure pattern B: bizhub PRO C6501 Internally provided pattern No. 7 Contnoe; typical one among light exposure patterns continuously formed in the direction perpendicular to the direction of a photoreceptor axis.
Light exposure pattern C: bizhub PRO C6501 Internally provided pattern No. 1 Linel; typical one among light exposure patterns continuously formed in the direction parallel to the direction of a photoreceptor axis.

As is clear from performance evaluation results in Table 1, those satisfying the condition of ΔL≧10 μm are able to accomplish the objective of the present invention.

EFFECT OF THE INVENTION

In the present invention, reduced can be interferential streaks produced in a halftone image when using a photoreceptor support (also called a drawn tube) having been subjected to tool bit cutting processing, and provided can be an electrophotographic photoreceptor capable of obtaining high quality in response to the light printing field or the like and an image forming method employing the electrophotographic photoreceptor.

What is claimed is:

1. An electrophotographic photoreceptor comprising a cylindrical support and provided thereon, a photosensitive layer, the cylindrical support comprising a processing profile regularly formed along a central axis, provided on a circumferential surface of the cylindrical support, wherein the processing profile satisfies Formula 1:

$$\Delta L \geqq 10\ \mu m, \qquad \text{Formula 1}$$

where ΔL represents a difference between a processing period width and another processing period width in a central axis direction of the cylindrical support within an image region.

2. The electrophotographic photoreceptor of claim 1, comprising the cylindrical support and provided thereon, an intermediate layer and the photosensitive layer, wherein the intermediate layer comprises a particle.

3. An image forming method comprising the step of: forming an image employing the electrophotographic photoreceptor of claim 1.

4. An image forming method comprising the step of: forming an image employing the electrophotographic photoreceptor of claim 2.

5. The electrophotographic photoreceptor of claim 1, wherein the processing profile and the processing period width are a cutting processing profile and a cutting processing period width, respectively.

* * * * *